US010190350B2

(12) United States Patent
Oshima

(10) Patent No.: US 10,190,350 B2
(45) Date of Patent: Jan. 29, 2019

(54) RETRACTING DEVICE

(71) Applicant: Sugatsune Kogyo Co., Ltd., Tokyo (JP)

(72) Inventor: Kazuyoshi Oshima, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 15/538,645

(22) PCT Filed: Nov. 13, 2015

(86) PCT No.: PCT/JP2015/081938
§ 371 (c)(1),
(2) Date: Jun. 21, 2017

(87) PCT Pub. No.: WO2016/103965
PCT Pub. Date: Jun. 30, 2016

(65) Prior Publication Data

US 2017/0350178 A1 Dec. 7, 2017

(30) Foreign Application Priority Data

Dec. 22, 2014 (JP) ..... 2014-258352

(51) Int. Cl.
*E05F 1/16* (2006.01)
*E05F 1/10* (2006.01)
(Continued)

(52) U.S. Cl.
CPC ..... *E05F 1/16* (2013.01); *E05F 1/1066* (2013.01); *E05F 3/02* (2013.01); *E05F 3/14* (2013.01);
(Continued)

(58) Field of Classification Search
CPC ... E05F 1/16; E05F 1/1066; E05F 1/08; E05F 3/02; E05F 3/14; E05Y 2900/132;
(Continued)

(56) References Cited

U.S. PATENT DOCUMENTS 3,278,979 A * 10/1966 Clement ..... E05F 1/16 16/66
3,732,594 A * 5/1973 Mills ..... E05F 1/16 16/200
(Continued)

FOREIGN PATENT DOCUMENTS

CN 201241321 Y 5/2009
CN 202468810 U 10/2012
(Continued)

OTHER PUBLICATIONS

JPO, Notice of Reason for Refusal dated May 23, 2017 in corresponding Japanese Patent Application No. 2016-521376 (with English translation), 4 pages.
(Continued)

*Primary Examiner* — William L Miller
(74) *Attorney, Agent, or Firm* — Masuvalley & Partners

(57) ABSTRACT

Provided is a retracting device which can decrease a difference of restoring force of a tension coil spring between a retracted position and a stop position. The retracting device of the present invention includes a base 12, a slider 14 which can catch a trigger 8 and move from the stop position to the retracted position with respect to the base 12 and a tension coil spring (B) for relatively moving the slider 14 which has caught the trigger 8 from the stop position to the retracted position with respect to the base 12 to apply force for assisting the closing operation to a sliding door 1. The tension coil spring (B) is an initially-tensioned spring in which a coil closely contacts and which has initial tension in
(Continued)

a direction in which the coil closely contacts when it is in a natural length.

1 Claim, 9 Drawing Sheets

(51) Int. Cl.
*E05F 3/02* (2006.01)
*E05F 3/14* (2006.01)

(52) U.S. Cl.
CPC ... *E05Y 2201/488* (2013.01); *E05Y 2900/132* (2013.01); *E05Y 2900/20* (2013.01); *Y10T 16/593* (2015.01)

(58) Field of Classification Search
CPC ..... E05Y 2900/20; E05Y 2201/488; Y10T 16/27; Y10T 16/56; Y10T 16/593; Y10T 16/61; Y10S 16/10; E05D 13/1207
USPC ..... 16/72, 71, 49, 85, DIG. 10; 49/404, 414
See application file for complete search history.

(56) References Cited

U.S. PATENT DOCUMENTS 3,887,962 A * 6/1975 Mills ..... E05F 1/16 16/200
4,819,295 A * 4/1989 Kaftan ..... E05F 1/16 16/71
5,131,188 A * 7/1992 Hutchison ..... E05F 1/16 16/72
5,659,999 A * 8/1997 Benson ..... E05F 1/16 16/72
6,691,465 B1 * 2/2004 Stephan ..... E05F 1/16 16/72
8,186,489 B2 * 5/2012 Zimmer ..... E05F 1/16 188/265
8,793,839 B2 8/2014 Iwaki
9,435,152 B2 * 9/2016 Zimmer ..... E05F 1/16
9,657,506 B2 * 5/2017 Bantle ..... E05D 13/1207
2009/0096339 A1 * 4/2009 Worner ..... E05F 1/16 312/334.44
2014/0026357 A1 * 1/2014 Zimmer ..... E05F 1/16 16/72
2016/0076288 A1 * 3/2016 Bantle ..... E05F 1/16 49/417
2016/0369548 A1 * 12/2016 Dodge ..... E05F 5/003
2017/0196356 A1 * 7/2017 Gasser ..... A47B 88/467

FOREIGN PATENT DOCUMENTS

CN 103080454 A 5/2013
CN 104011309 A 8/2014
JP H05-23763 A 2/1993
JP 2008-190275 A 8/2008
JP 2009-79392 A 4/2009
JP 2013-524042 A 6/2013
JP 5285679 B2 9/2013
WO 2013/146443 A1 10/2013

OTHER PUBLICATIONS

International Search Authority/JPO, International Search Report dated Feb. 2, 2016 in International Patent Application No. PCT/JP2015/081938 (with English translation), 2 pages.
Wang Mingxian, "Training materials for technical training of agricultural machinery workers, Spring production technology", China Machine Press, published on Jan. 31, 1988, p. 46-47 (total 10 pages with English translation).
SIPO, Notification of First Office Action dated Jan. 17, 2018 in corresponding Chinese Patent Application No. 201580067043.4, total 10 pages with English translation.
Max Nusser et al., "Technische Federn—Herstellung und Berechunung", Jan. 1, 2010, pp. 18-19 www.schmid-federn.de/pdf/Federnfibel.pdf.
EPO, Supplementary European Search Report dated Aug. 22, 2018 in EP Patent Application No. 15872534.1, total 4 pages.

* cited by examiner

Prior Art

RETRACTING DEVICE

RELATED APPLICATIONS

This application is the U.S. National Phase of and claims priority to International Patent Application No. PCT/JP2015/081938, International Filing Date Nov. 13, 2015, entitled RETRACTING DEVICE; which claims benefit of Japanese Patent Application No. 2014-258352 filed Dec. 22, 2014 entitled RETRACTING DEVICE; both of which are incorporated herein by reference in their entireties.

FIELD OF INVENTION

The present invention relates to a retracting device for assisting a closing operation and/or an opening operation of a door such as a sliding door, a hinged door and a folding door or a furniture component such as a drawer.

BACKGROUND OF THE INVENTION

A retracting device for assisting a closing operation of a door or a furniture component for facilitating closing of the door or the furniture component has been known. The retracting device for assisting the closing operation is also called as a closer. When a user moves the door or the furniture component to a predetermined position in a closing direction, the retracting device applies force in the closing direction to the door or the furniture component so that the door or the furniture component automatically moves to a closing position.

As shown in FIGS. 14A and 14B, in a patent document 1: JP H5-23763A, there is disclosed a retracting device including a base 51 to be attached to a furniture main body, a slider 52 which can move from a stop position (see FIG. 14A) to a retracted position (see FIG. 14B) with respect to the base 51 and a tension coil spring 53 for moving the slider 52 from the stop position to the retracted position. A trigger 54 is attached to a drawer. When the user moves the drawer at an opened position toward the closing direction to locate the drawer at the stop position shown in FIG. 14A, the slider 52 catches the trigger 54 and rotates. Then, the tension coil spring 53 moves the slider 52 from the stop position to the retracted position to apply the force for assisting the closing operation to the drawer.

In this regard, as described in a patent document 2: JP 2008-190275A, a retracting device for assisting the closing operation and the opening operation of the door or the furniture component is existed. This is a retracting device in which a slider for assisting the closing operation and a slider for assisting the opening operation are movably provided on a base, and an operating principle thereof is the same as that of the retracting device described in the patent document 1.

SUMMARY OF THE INVENTION

However, in the conventional retracting device, it is required that the user should move the slider 52 from the retracted position shown in FIG. 14B to the stop position shown in FIG. 14A together with the door or the furniture component in order to accumulate energy for restoration into the tension coil spring 53. As the slider 52 moves from the retracted position toward the stop position, the tension coil spring 53 gradually expands, and thereby restoring force of the tension coil spring 53 also increases. In the case where a difference of the restoring force of the tension coil spring 53 between the retracted position and the stop position is large, there is a problem that the user feels a weight and a feeling deteriorates.

Thus, the present invention is intended to provide a retracting device which can decrease the difference of the restoring force of the tension coil spring between the retracted position and the stop position.

In order to solve the above problem, one aspect of the present invention is a retracting device including a base, a moving body which can catch a trigger and relatively move from a stop position to a retracted position with respect to the base and a tension coil spring for relatively moving the moving body which has caught the trigger from the stop position to the retracted position with respect to the base to apply force for assisting a closing operation and/or an opening operation to a door or a furniture component, wherein the tension coil spring is an initially-tensioned spring in which a coil closely contacts and which has initial tension in a direction in which the coil closely contacts when it is in a natural length.

According to the one aspect of the present invention, it is possible to increase the number of turns of the tension coil spring with ensuring restoring force of the tension coil spring at the retracted position to decrease a spring constant thereof. Thus, it is possible to decrease a difference of the restoring force of the tension coil spring between the retracted position and the stop position.

BRIEF DESCRIPTION OF THE DRAWINGS

(FIG. 1A shows a planar view, FIG. 1B shows a side view and FIG. 1C shows a front view).

(FIG. 2A shows a planar view of the retracting device and FIG. 2B shows an exploded planar view of the retracting device).

(FIG. 3A shows a vertical cross-sectional view of the retracting device and FIG. 3B shows an exploded side view of the retracting device).

(FIG. 4A shows a planar view of the retracting device when a slider is at a stop position, FIG. 4B shows a planar view of the retracting device when the slider is on the middle of movement from the stop position to a retracted position and FIG. 4C shows a planar view of the retracting device when the slider is at the retracted position).

(FIG. 5A shows a planar view of the retracting device when the slider is at the retracted position, FIG. 5B shows a planar view of the retracting device when the slider is on the middle of movement from the retracted position to the stop position and FIG. 5C shows a planar view of the retracting device when the slider is at the stop position).

(FIG. 9A shows the retracting device when a rotating body is at a stop position and FIG. 9B shows the retracting device when the rotating body is at a retracted position).

(FIG. 14A shows the retracting device when a slider is at a stop position and FIG. 14B shows the retracting device when the slider is at a retracted position).

MODE FOR CARRYING OUT THE INVENTION

Hereinafter, description will be given to a retracting device according to an embodiment of the present invention with reference to the accompanying drawings. Please be noted that the retracting device of the present invention can be embodied in various forms and the present invention is not limited to the embodiment described in the specification. This embodiment is provided to be intended to allow a person having ordinary skill in the art to sufficiently understand the scope of the present invention by sufficiently providing disclosure of the specification.

Figure 1A:
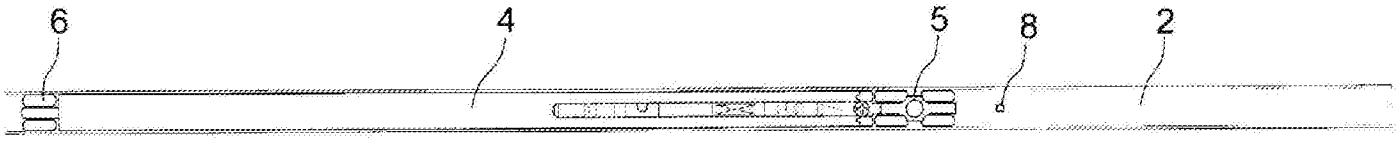
FIGS. 1A through 1C are external view of a retracting device according to a first embodiment of the present invention
Figure 1B:
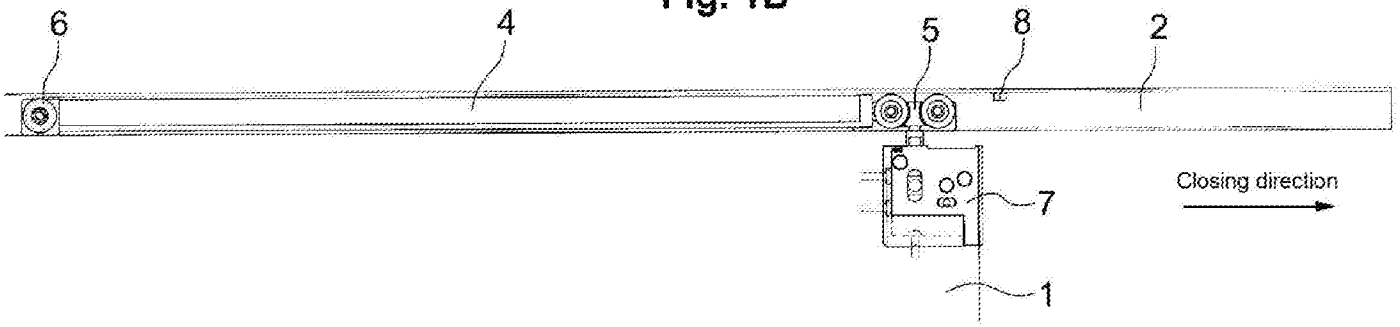
Figure 1C:
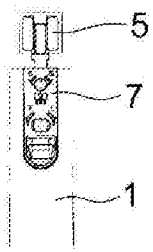

FIG. 1 is an external view of a retracting device according to a first embodiment of the present invention. FIG. 1A shows a planar view of a retracting device 4 inserted into a guide rail 2, FIG. 1B shows a side view of the retracting device 4 and FIG. 1C shows a front view of the retracting device 4 viewed from a length direction of the guide rail 2. A trigger 8 is attached to the guide rail 2. When a user moves a sliding door 1 at an opened position to the trigger 8 in a closing direction, a slider 14 (see FIG. 2) of the retracting device 4 catches the trigger 8 and tension coil springs 15*a*, 15*b* (see FIG. 2) of the retracting device 4 move the sliding door 1 to a closed position.

The guide rail 2 for guiding movement of the sliding door 1 is fixed to a frame of the sliding door 1. Door rollers 5, 6 are provided at both end portions of the retracting device 4 in a moving direction. The retracting device 4 can move in the guide rail 2 in a longitudinal direction thereof due to the door rollers 5, 6. The sliding door 1 is suspended from the door roller 5 through a position adjustment unit 7. The position adjustment unit 7 adjusts a position of the sliding door 1 in the vertical direction and the width direction with respect to the door roller 5.

Figure 2A:
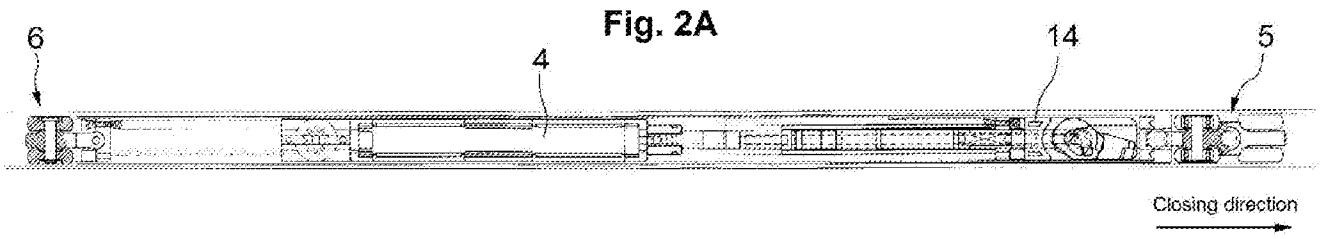
FIGS. 2A and 2B are detail view of the retracting device of this embodiment
Figure 2B:
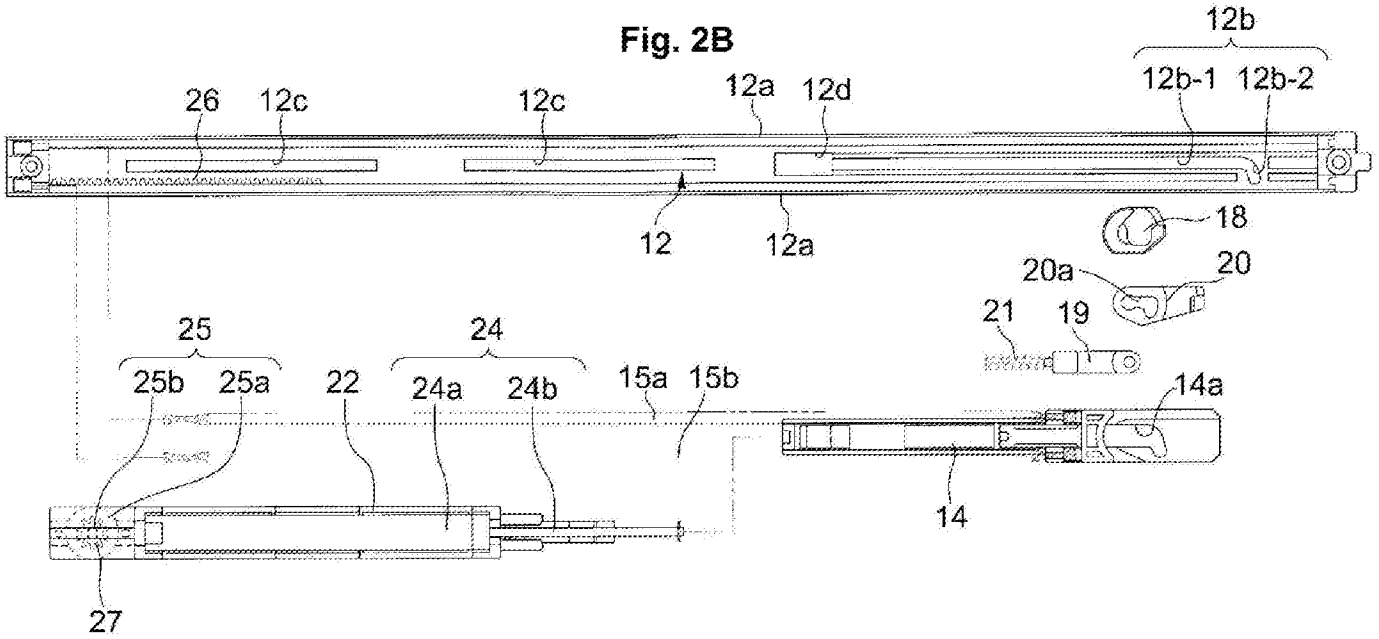
Figure 3A:
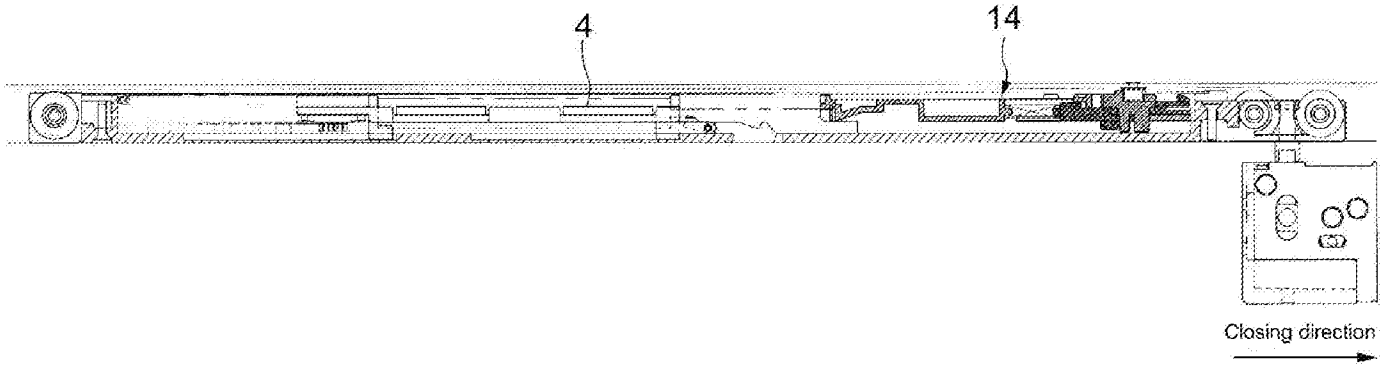
FIGS. 3A and 3B detail view of the retracted device of this embodiment
Figure 3B:
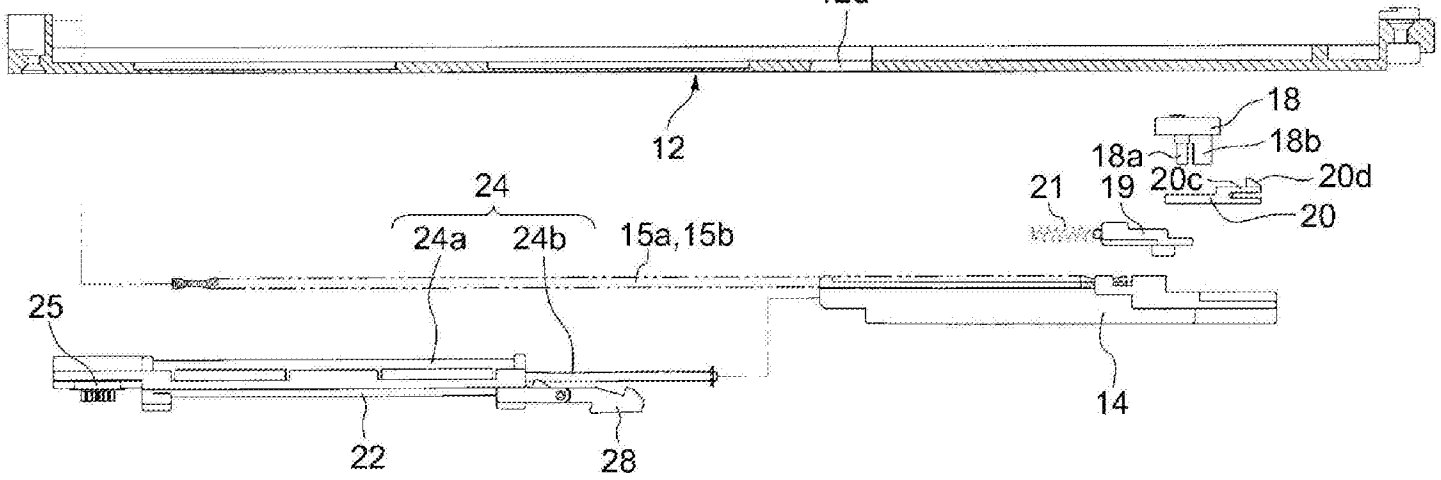

Each of FIGS. 2 and 3 shows a detail view of the retracting device 4. FIG. 2A shows a planar view of the retracting device 4 and FIG. 2B shows an exploded planar vide of the retracting device 4. FIG. 3A shows a vertical cross-sectional view of the retracting device and FIG. 3B is an exploded side view of the retracting device 4.

Figure 14A:
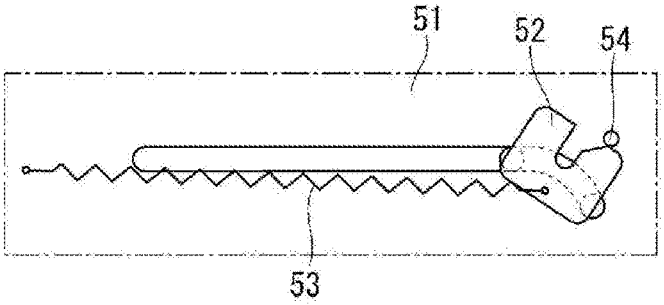
FIGS. 14A and 14B are planar view of a conventional retracting device
Figure 14B:
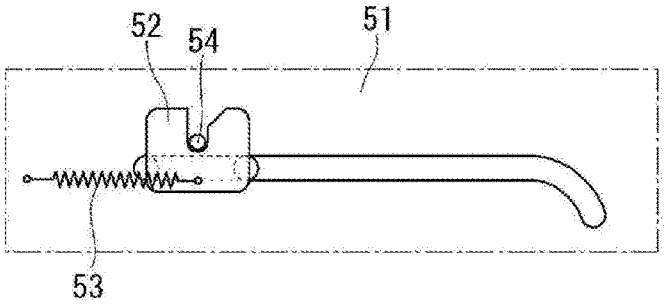
Prior Art Fig. 14B

As shown in FIG. 2B, the retracting device 4 includes a base 12 which is elongated in the length direction of the guide rail 2, a slider 14 as a moving body which is movably guided in the length direction by the base 12 and tension coil springs 15*a*, 15*b* bridged between the base 12 and the slider 14. A catcher 18 which can catch the trigger 8 is provided to the slider 14. A basic operating principle of the retracting device 4 is the same as that of the conventional retracting device shown in FIG. 14. Namely, when the user moves the retracting device 4 to a position of the trigger 8 shown in FIG. 1, the catcher 18 provided to the slider 14 catches the trigger 8 and rotates. Then, the tension coil springs 15*a*, 15*b* move the slider 14 from a stop position (see FIG. 4A) to a retracted position (see FIG. 4C) with respect to the base 12. Since the trigger 8 is fixed to the guide rail 2, the base 12 moves in the closing direction without changing the position of the slider 14, and thereby the sliding door 1 moves in the closing direction together with the base 12.

A detailed configuration of the retracting device 4 is as follows. As shown in FIG. 2B, the slider 14 is provided to the base 12 so as to be movable in the longitudinal direction. A liner groove 12*b*-1 with which the slider 14 is engaged is formed on the base 12. The slider 14 moves on the base 12 in the longitudinal direction with being guided by a pair of opposing side walls 12*a* and the liner groove 12*b*-1 of the base 12.

The catcher 18 for catching the trigger 8 is provided to the slider 14. The catcher 18 is supported on a tip end portion of a trigger pusher 19 so as to be rotatable around a vertical axis 18*a* (see FIG. 3B). A malfunction recovery cam 20 is also supported by the trigger pusher 19 so as to be rotatable round the vertical axis 18*a*. The vertical axis 18*a* and a locking piece 18*b* (see FIG. 3B) of the catcher 18 pass through an opening 20*a* of the malfunction recovery cam 20 and are movably engaged with a catcher guiding groove 14*a* of the slider 14 and a catcher guiding groove 12*b* of the base 12. The trigger pusher 19 is supported by the slider 14 so as to be movably in the longitudinal direction. A compressed spring 21 is intervened between the trigger pusher 19 and the slider 14.

As shown in FIG. 2B, the catcher guiding groove 12*b* constituted of the linear groove 12*b*-1 and a locking groove 12*b*-2 laterally bent at an end portion of the liner groove 12*b*-1 in the closing direction is formed on a bottom surface of the base 12. When the locking piece 18*b* of the catcher 18 gets into the locking groove 12*b*-2, the catcher 18 rotates, and thereby the slider 14 is locked at the stop position shown in FIG. 4A. The trigger pusher 19 and the compressed coil spring 21 keep a state that the locking piece 18*b* of the catcher 18 is in the locking groove 12*b*-2, thereby keeping the stop position of the slider 14.

The malfunction recovery cam 20 is provided for recovering the slider 14 to the stop position even when the lock of the slider 14 is released by malfunction. When the slider 14 is released from the stop position by the malfunction, the catcher 18 cannot receive the trigger 8. Thus, even if the sliding door 1 is moved in the closing direction to move the slider 14 closer to the trigger 8, the catcher 18 cannot catch the trigger 8. Even in such a case, an upper piece 20*c* (see FIG. 3B) of the malfunction recover cam 20 warps and a locking piece 20*d* of the upper piece 20*c* catches the trigger 8. Thus, it is possible to recover the slider 14 to the stop position.

As shown in FIG. 2B, dampers 24, 25 are provided for braking the movement of the slider 14 caused by the tension coil springs 15*a*, 15*b*. The dampers 24, 25 in this embodiment contain a linear damper 24 and a rotary damper 25. The linear damper 24 operates just after the slider 14 released from the stop position, then the operation switches from the linear damper 24 to the rotary damper 25 and the rotary damper 25 starts to operate. In this regard, only the linear damper 24 may be provided between the slider 14 and the base 12 and only the linear damper 24 may operate.

A damper base 22 is movably provided between the pair of opposing side walls 12*a* of the base 12. A pair of damper base guiding grooves 12*c* are formed on a bottom portion of the base 12 in the longitudinal direction. The damper base 22 moves on the base 12 in the longitudinal direction with being guided by the pair of opposing side walls 12*a* and the damper base guiding groove 12*c* of the base 12.

A damper main body 24*a* of the linear damper 24 and a damper main body 25*a* of the rotary damper 25 are fixed to the damper base 22. A rod 24*b* of the linear damper 24 is coupled to the slider 14. A rack 26 is provided on the base 12 on the opposite side of the closing direction of the sliding door 1 and a pinion 27 of a rotational axis 25*b* of the rotary damper 25 meshes with the rack 26.

While the slider 14 moves from the stop position (see FIG. 4A) to a damper switching position (see FIG. 4B) with respect to the base 12, a damper lock 28 (see FIG. 3B) of the damper base 22 engages with a lock hole 12*d* of the base 12 and a distance between the slider 14 and the damper base 22 decreases, and thereby the liner damper 24 operates. When the slider 14 passes through the damper switching position (see FIG. 4B) with respect to the base 12, the engagement between the damper lock 28 of the damper base 22 and the lock hole 12*d* of the base 12 is released and the damper base 22 moves with respect to the base, and thereby the rotary damper 25 operates.

Figure 4A:
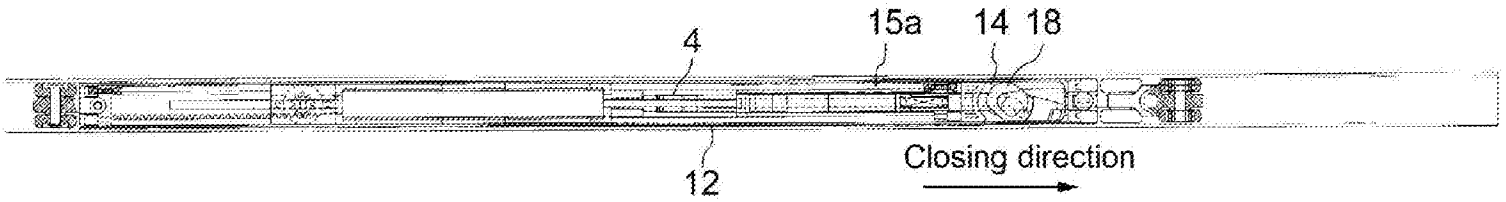
FIGS. 4A through 4C operation view of the retracting device when a sliding door is closed
Figure 4B:
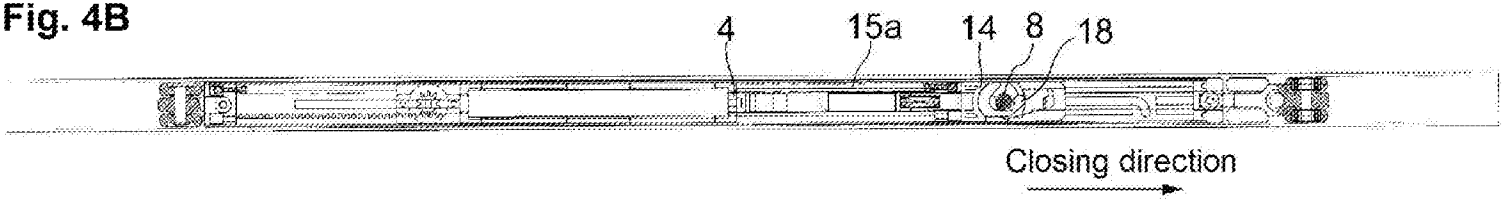
Figure 4C:
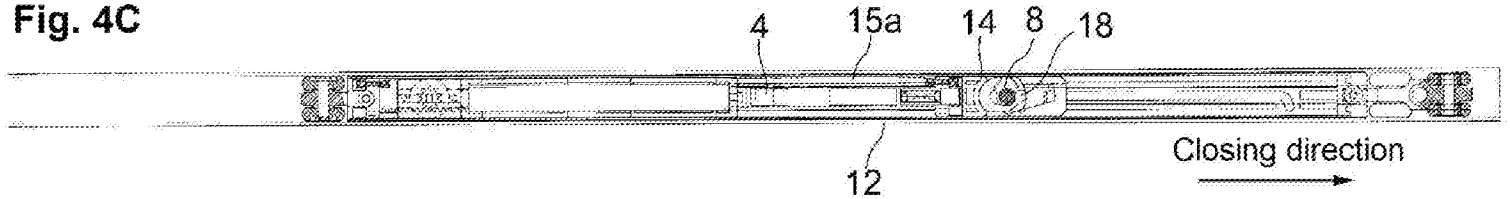

An operation of the retracting device 4 when the sliding door 1 is closed is as follows. FIG. 4A shows a planar view of the retracting device 4 when the slider 14 is at the stop position, FIG. 4B shows a planar view of the retracting device 4 when the slider 14 is at the damper switching position (in the middle of the movement from the stop position to the retracted position) and FIG. 4C shows a planar view of the retracting device 4 when the slider 14 is at the retracted position.

When the user closes the sliding door 1, the catcher 18 moves to the trigger 8 and the catcher 18 contacts the trigger 8, and then the catcher 18 rotates to catch the trigger 8 as shown in FIG. 4A. Then, the tension coil springs 15*a*, 15*b* (in FIG. 4, the tension coil spring 15*b* is not illustrated) move the slider 14 from the stop position shown in FIG. 4A to the retracted position shown in FIG. 4C. Since the catcher 18 has caught the trigger 8 fixed to the guide rail 2, the catcher 18 does not move and the base 12 moves in the closing direction without movement of the catcher 18. With this configuration, force for assisting the closing operation is applied to the sliding door 1. Actually, the slider 14 stops just before the slider 14 reaches the retracted position shown in FIG. 4C. This is because the sliding door 1 contacts the frame and is located at the closed position. The retracting device 4 applies the force in the closing direction to the sliding door 1 located at the closed position to stabilize the sliding door 1.

Figure 5A:
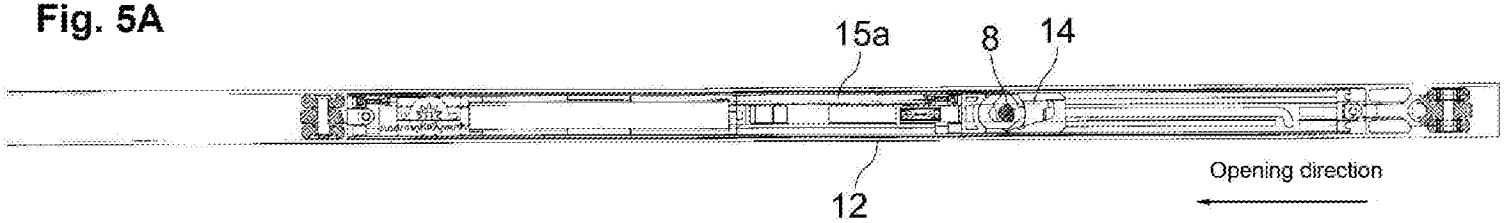
FIGS. 5A through 5C are operation view of the retracting device when the sliding door is opened

An operation of the retracting device 4 when the sliding door 1 is opened is as follows. FIG. 5A shows a planar view of the retracting device 4 when the slider 14 is at the retracted position, FIG. 5B shows a planar view of the retracting device 4 when the slider 14 is in the middle of the movement from the retracted position to the stop position and FIG. 5C shows a planar view of the retracting device 4 when the slider 14 is at the stop position.

Figure 5B:
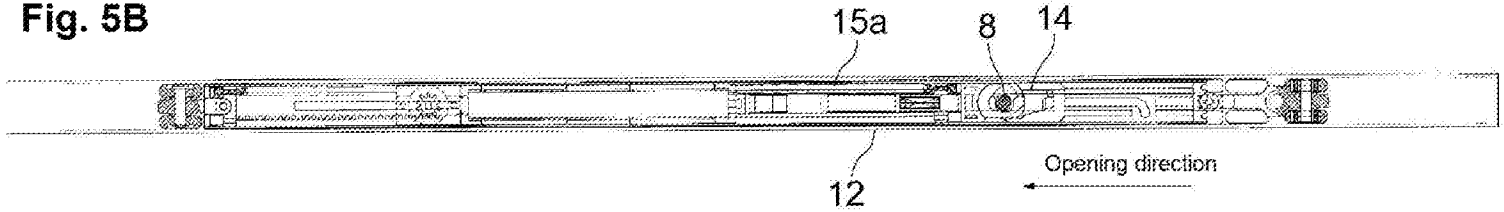
Figure 5C:
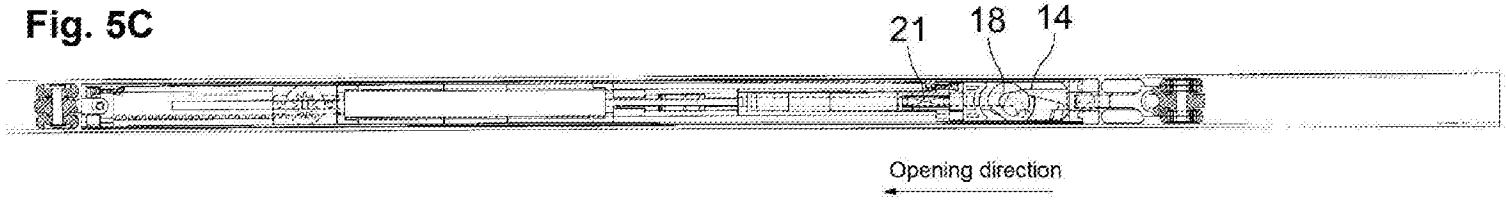

When the user opens the sliding door 1, the base 12 moves in the opening direction with respect to the slider 14 as shown in FIGS. 5A to 5C. The tension coil springs 15*a*, 15*b* (in FIGS. 5A-5C, the tension coil spring 15*b* is not illustrated) bridged between the base 12 and the slider 14 gradually expand and energy for the recovery is accumulated. As shown in FIG. 5C, when the slider 14 moves to the stop position, the catcher 18 rotates and the slider 14 is locked at the stop position. After that, the catcher 18 releases the trigger 8 and the slider 14 is held at the stop position.

Figure 6A:
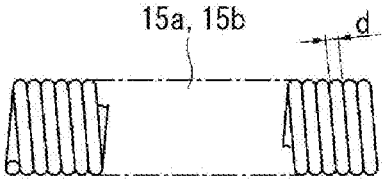
FIGS. 6A and 6B are side view of a tension coil spring and FIG. 6B is a front view of the tension coil spring.
Figure 6B:
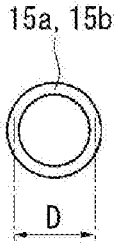

FIG. 6 shows a detail view of the tension coil springs 15*a*, 15*b*. FIG. 6A shows a side view of the tension coil springs 15*a*, 15*b* and FIG. 6B shows a front view of the tension coil springs 15*a*, 15*b*. As each of the tension coil springs 15*a*, 15*b*, an initially-tensioned spring in which a coil closely contacts and which has initial tension in a direction in which the coil closely contacts when it is in a natural length.

Figure 7A:
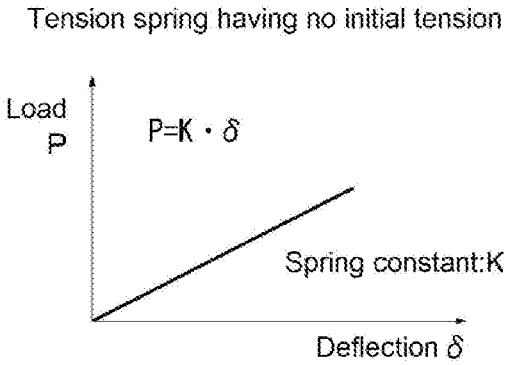
FIGS. 7A and 7B are graph showing force-deflection characteristics of a tension coil spring having no initial tension and FIG. 7B is a graph showing force-deflection characteristics of a tension coil spring having initial tension.

FIG. 7A shows force-deflection characteristics of a conventional tension coil spring having no initial tension. In the tension coil spring having no initial tension, when deflection σ is zero, that is when the tension coil spring is in a natural length, force P is zero. When a spring constant is defined as K, P=K×σ is established.

Figure 7B:
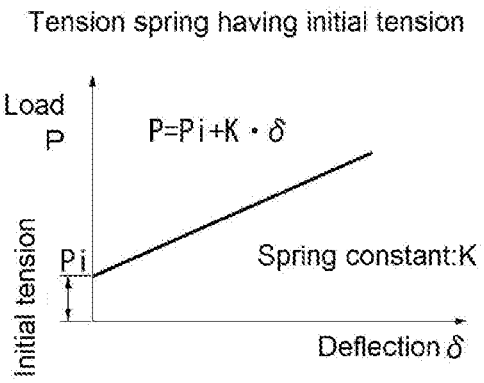

FIG. 7B shows force-deflection characteristics of the tension coil springs 15*a*, 15*b* of this embodiment each having initial tension. In each of the tension coil springs 15*a*, 15*b* having the initial tension, when deflection σ0 is zero, that is when each of the tension coil springs 15*a*, 15*b* is in a natural length, each of the tension coil springs 15*a*, 15*b* has initial tension Pi. When a spring constant is defined as K, P=Pi+K×σ is established. The initial tension Pi is calculated by the following equation.

$$Pi = \frac{\pi d^3}{8D} \times \tau i \qquad \text{[Equation 1]}$$

d: a diameter of material, D: a mean diameter of the coil, τi: initial tension

Figure 8:
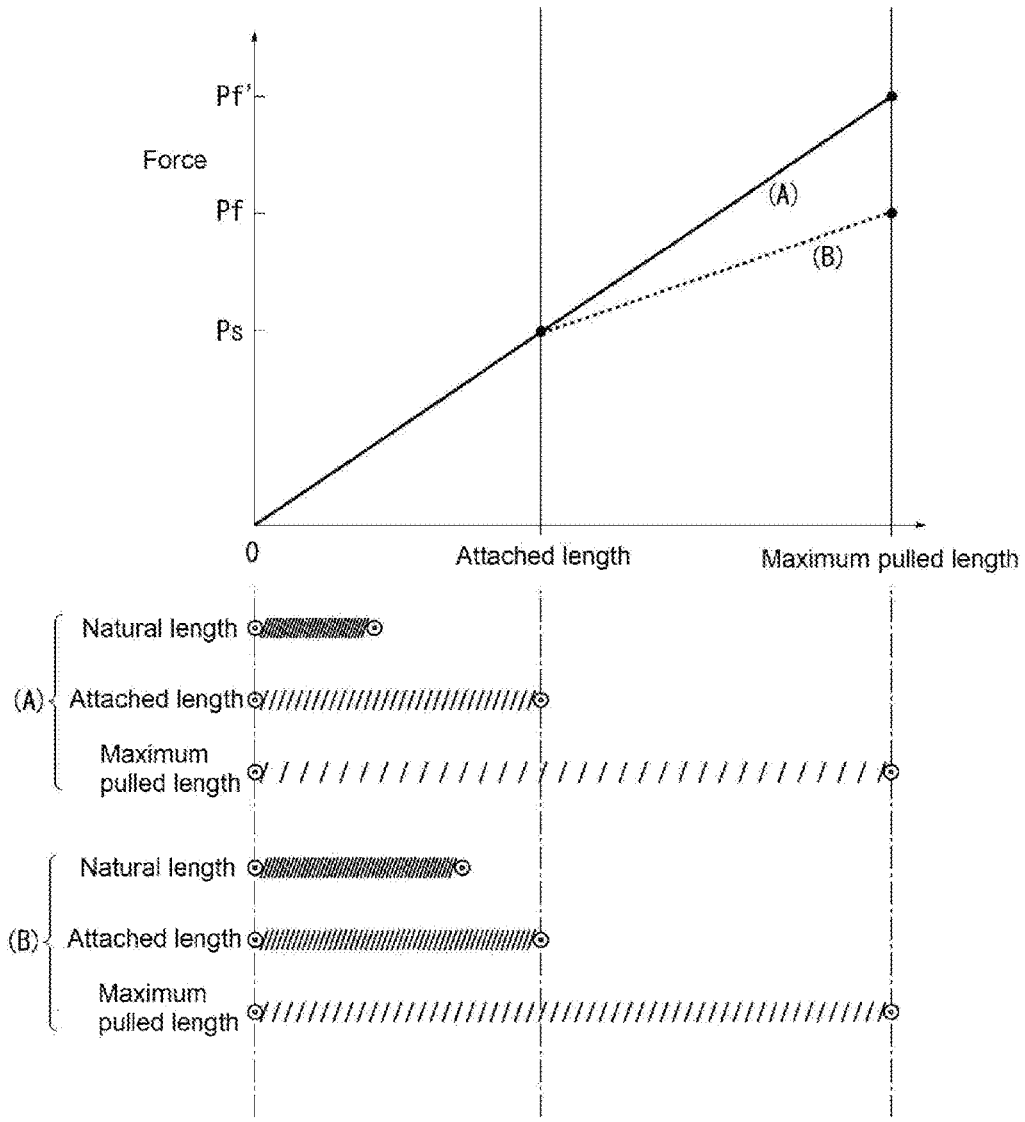
FIG. 8 is a graph showing force-deflection characteristics of the tension coil spring provided in the retracting device of this embodiment.

FIG. 8 shows force-deflection characteristics of the tension coil springs 15*a*, 15*b* provided in the retracting device 4. (A) in FIG. 8) shows the conventional tension coil spring having no initial tension and (B) in FIG. 8 shows the tension coil springs 15*a*, 15*b* of this embodiment which have the initial tension. The words of "maximum pulled length" of a horizontal axis of the graph in FIG. 8 represents a length of each of the tension coil springs (A, B) when the slider 14 is at the stop position and the words of "attached length" represents a length of each of the tension coil springs (A, B) when the slider 14 is at the retracted position. When the slider 14 moves from the stop position to the retracted position, the tension coil springs (A, B) are compressed from "the maximum pulled length" to "the attached length". The tension coil springs (A, B) expand and compress between "the maximum pulled" and "the attached length".

Here, in order to apply constant force in the closing direction to the sliding door 1 located at the closed position, it is assumed that restoring force Ps of each of the tension coil springs (A, B) is constant. Further, since "the attached length" is decided according to a size of the retracting device, it is assumed that "the attached length" of each of the tension coil springs (A, B) is constant. Thus, in the tension coil spring (B) having the initial tension, it is possible to increase the number of turns of the coil compared with the tension coil spring (A) having no initial tension, and thus it is possible to decrease the spring constant. This is because it is required to increase the deflection σ for ensuring the restring force Ps in the case of the tension coil spring (A) having no initial tension and it is required to shorten the natural length and reduce the number of turns of the coil for increasing the deflection σ. In contrast, in the case of the tension coil spring (B) having the initial tension, since the tension coil spring (B) has the initial tension, it is possible to ensure the restoring force Ps without increasing the deflection σ. Thus, it is possible to make the natural length long and increase the number of turns of the coil as the deflection σ can be small. Of course, the spring constant can be smaller as the number of turns of the coil more increases.

As shown in the graph in FIG. 8, in the case of the tension coil spring (B) having the initial tension, since it is possible to decrease the spring constant, it is possible to decrease the force at the time of "the maximum pulled length" from Pf' to Pf. Further, since it is also possible to decrease a difference Pf–Ps of the restoring force between the retracted position and the stop position, it is possible to prevent the user from feeling heavy even when the user moves the sliding door 1 from the retracted position to the stop position.

Figure 9A:
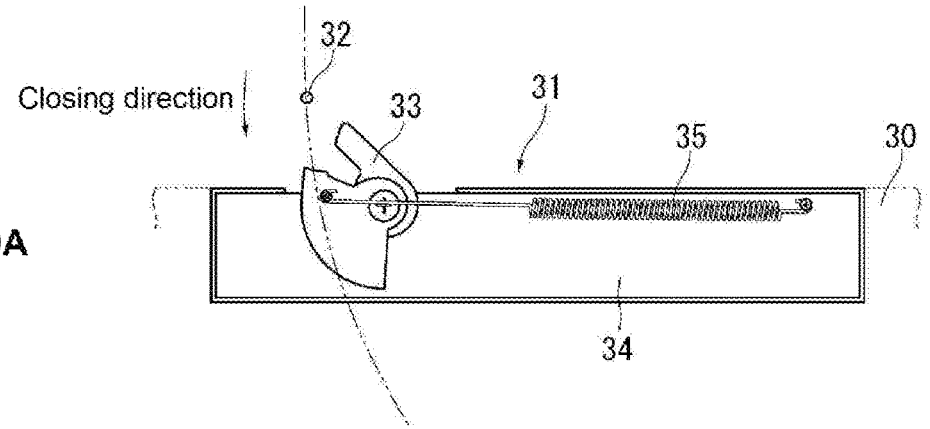
FIGS. 9A and 9B are planar view showing a retracting device for a hinged door according to a second embodiment of the present invention
Figure 9B:
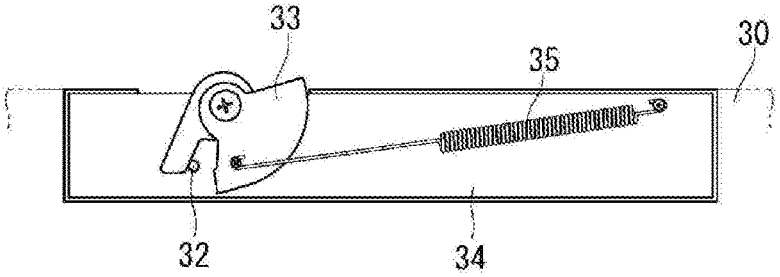

FIG. 9 shows a retracting device 31 according to a second embodiment of the present invention. The retracting device 31 according to the second embodiment is used for a hinged door and attached to a frame 30. FIG. 9A shows the retracting device 31 when a rotating body 33 is at a stop position and FIG. 9B shows the retracting device 31 when the rotating body 33 is at a retracted position. A trigger 32 is attached to the hinged door not shown in the drawings.

The retracting device 31 includes a base 34, the rotating body 33 as a moving body which can catch the trigger 32 and rotate from the stop position to the retracted position with respect to the base 34 and a tension coil spring 35 bridged between the rotating body 33 and the base 34. The tension coil spring 35 is an initially-tensioned spring in which a coil closely contact and which has initial tension in a direction in which the coil closely contact when it is in a natural length.

When the user rotates the hinged door located at an opened position to the rotating body 33 in the closing direction, the rotating body 33 catches the trigger 32 and the tension coil spring 35 rotates the rotating body 33 from the stop position to the retracted position. Force in the closing direction is applied to the hinged door along with the rotation of the rotating body 33.

In this regard, the present invention is not limited to the aspect embodied in the above embodiment and the present invention can be embodied in various embodiments without changing the gist of the present invention.

For example, although the retracting device 4 is attached to the sliding door 1 and the trigger 8 is attached to the frame in the retracting device 4 for the sliding door according to the first embodiment, it may be possible to attach the trigger 8 to the sliding door 1 and attach the retracting device 4 to the frame. Further, although the retracting device 31 is attached to the frame 30 and the trigger 32 is attached to the hinged door in the retracting device 31 for the hinged door according to the second embodiment, it may be possible to attach the trigger 32 to the frame 30 and attach the retracting device 31 to the hinged door.

Although the two tension coil springs 15*a*, 15*b* are provided in the retracting device 4 for the sliding door according to the first embodiment, it may be possible to provide only one tension coil spring in the retracting device 4. Further, only one of the tension coil springs may be an initially-tensioned spring. Furthermore, in the retracting device 4 according to the first embodiment, the slider 14 and the catcher 18 may be integrated.

Figure 10:
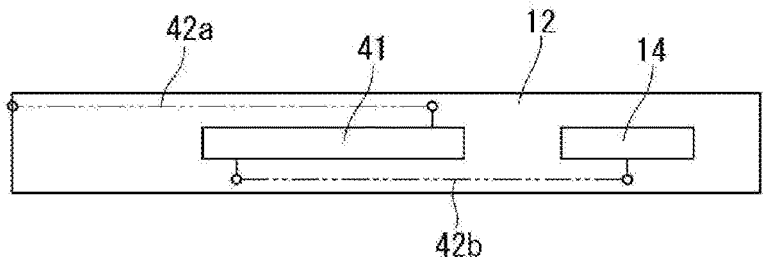
FIG. 10 is a schematic view showing another example of the retracting device for the hinged door.

As shown in FIG. 10, in the retracting device for the sliding door, it may be possible to arrange an intermediate slider 41 between the base 12 and the slider 14, bridge a first tension coil spring 42*a* between the base 12 and the intermediate slider 41 and bridge a second tension coil spring 42*b* between the intermediate slider 41 and the slider 14. In this case, at least one of the first and second tension coil springs 42*a*, 42*b* must be an initially-tensioned spring.

Figure 11:
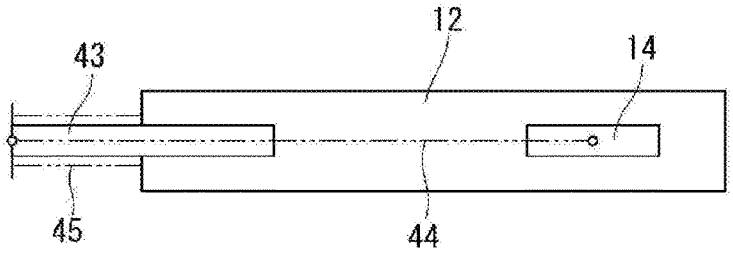
FIG. 11 is a schematic view showing yet another example of the retracting device for the hinged door.

Further, as shown in FIG. 11, in the retracting device for the sliding door, it may be possible to provide a coupling portion 43 which is movable in the longitudinal direction on the base 12, bridge a tension coil spring 44 between the coupling portion 43 and the slider 14 and arrange a compressed coil spring 45 between the coupling portion 43 and the base 12. By providing the compressed coil spring 45, it is possible to more decrease restoring force of the tension coil spring 44 at the stop position.

Figure 12:
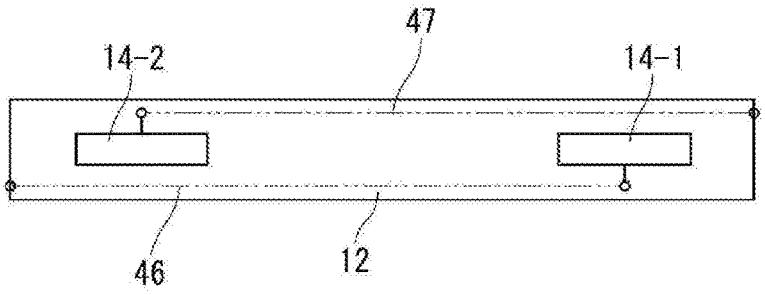
FIG. 12 is a schematic view showing yet another example of the retracting device for the hinged door.

Further, as shown in FIG. 12, in the retracting device for the sliding door, it may be possible to arrange a closing operation assist slider 14-1 and an opening operation assist slider 14-2 on the base 12. Further, it may be also possible to bridge a tension coil spring 46 between the base 12 and the closing operation assist slider 14-1 and bridge a tension coil spring 47 between the base 12 and the opening operation assist slider 14-2. With this configuration, it is possible to assist the closing operation and the opening operation of the sliding door. This retracting device is described in detail in JP 2012-107415A suggested by the applicant.

Figure 13:
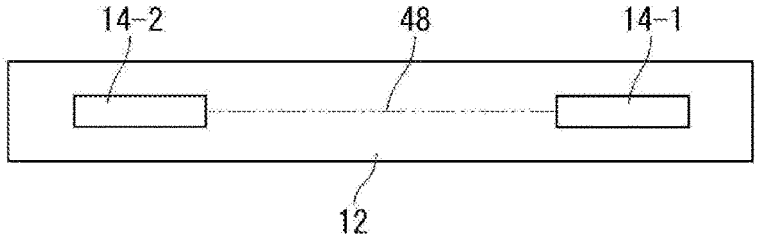
FIG. 13 is a schematic view showing yet another example of the retracting device for the hinged door.

Further, as shown in FIG. 13, in the retracting device for the sliding door, it may be possible to arrange the closing operation assist slider 14-1 and the opening operation assist slider 14-2 on the base 12 and bridge a tension coil spring 48 between the closing operation assist slider 14-1 and the opening operation assist slider 14-2. With this configuration, it is possible to assist the closing operation and the opening operation of the sliding door.

The present specification is based on JP 2014-258352 filed on Dec. 22, 2014. The entire disclosure of JP 2014-258352 is incorporated herein.

What is claimed is:

1. A retracting device, comprising:

a base;

a moving body which can catch a trigger and relatively move from a stop position to a retracted position with respect to the base; and a tension coil spring for relatively moving the moving body which has caught the trigger from the stop position to the retracted position with respect to the base to apply force for assisting a closing operation or an opening operation to a door or a furniture component, wherein the tension coil spring is an initially-tensioned spring in which adjacent turns of the tension coil are closely contacted and which has initial tension in a direction in which the adjacent turns are closely contacted as the adjacent turns are pushed against each other when it is in a natural length; and wherein a difference of a restoring force of the tension coil spring between the retracted position and the stop position is decreased.

* * * * *